US006024152A

United States Patent [19]

Rosenich

[11] Patent Number: 6,024,152

[45] Date of Patent: Feb. 15, 2000

[54] AWNING

[76] Inventor: Paul Rosenich, Simmeringer-Hauptstr. 60-64/6/6, A -1110, Wien, Austria

[21] Appl. No.: 09/043,734

[22] PCT Filed: Oct. 3, 1996

[86] PCT No.: PCT/EP96/04305

§ 371 Date: Mar. 24, 1998

§ 102(e) Date: Mar. 24, 1998

[87] PCT Pub. No.: WO97/13935

PCT Pub. Date: Apr. 17, 1997

[30] Foreign Application Priority Data

Oct. 6, 1995 [CH] Switzerland ..... 2960/95

[51] Int. Cl.[7] ..... E04F 10/06

[52] U.S. Cl. ..... 160/22; 160/66

[58] Field of Search ..... 160/22, 23.1, 66, 160/67, 26, 29, 33, 38; 135/88.11, 88.12

[56] References Cited

U.S. PATENT DOCUMENTS

| | | | |
|---|---|---|---|
| 3,782,443 | 1/1974 | Clauss et al. | 160/22 |
| 4,469,159 | 9/1984 | Lohausen | 160/22 |
| 4,566,516 | 1/1986 | Lohausen | 160/22 |
| 5,121,782 | 6/1992 | Renkhoff et al. | 160/22 |
| 5,133,397 | 7/1992 | Lohausen | 160/22 |
| 5,427,168 | 6/1995 | Lohausen | 160/22 X |
| 5,492,162 | 2/1996 | Lohausen | 160/22 |
| 5,673,739 | 10/1997 | Brutsaert | 160/22 |

*Primary Examiner*—David M. Purol

[57] ABSTRACT

An awning has a sleeve rail acting as a multi-purpose component for a particular degree of integratability. The awning displays good horizontal and vertical rigidity and so reduces the number of components required. The awning in particular enables the number of assembly personnel at the installation site to be reduced. A shaft for the canvas helps to reduce the size of the awning even further whilst retaining the same degree of stability.

21 Claims, 6 Drawing Sheets

AWNING

CROSS-REFERENCES TO RELATED APPLICATIONS

Not Applicable.

STATEMENT REGARDING FEDERALLY SPONSORED RESEARCH OF DEVELOPMENT

Not Applicable.

BACKGROUND OF THE INVENTION

1. Field of the Invention

This invention relates to an awning and more particularly to an awning with a canvas shaft and at least one holder for fastening the awning to a wall or a ceiling.

2. Discussion of Relevant Art

For example, an awning of this type is available on the market under the name Discus Vertikal (trade name of the company Lohausen). A similar awning is described in DE-A1 4103474.

Known awnings, corresponding to the precharacterizing clauses mentioned, have proved in practice to be stable, narrow or integrated awnings. The use of such awnings generally presents no problems but various customers required smaller but more efficient awnings (area of the extendable awning canvas in relation to the volume of the awning box as large as possible).

The Applicant, as patent proprietor, has become aware of a number of patents in this area and it is intended to outline below the development which led to the prior art used, so that it will be clear just how valuable is the invention described below.

DE-C-2909306 describes an awning which, under the trade name "Superflach", as a speciality compared with the prior art known at the time, has a rectangular mounting tube which was arranged in approximately a horizontal plane with the canvas shaft axis and, as a support element, held bearing blocks, swivel arms and the like. Since the mounting tube was practically held at its two ends by wall holders or support arms which projected from wall holders, there was a certain limit to the length of the mounting tubes (sag) and a limit to the width of the awning. Furthermore, such an awning was relatively deep since, owing to its spatial extension and owing to the space required by the bearing blocks, holders and the like mounted thereon, the mounting tube increased the depth of the total structure with wall holder, canvas shaft and swivel arms.

In comparison, in the novel design the depth is to be reduced and the flexural strength of the awning structure is to be improved to counteract sagging, so that larger awning widths are possible.

DE-C-3001919 has already attempted to reduce the depth and has created support elements which, in terms of the function, approximately corresponded to an above-mentioned mounting tube but reduced the depth compared with the "Superflach" awning. The support element, which projects upward as a narrow central web in front of the canvas shaft and over the total height of the latter and is fastened to support arms which grip under the canvas shaft, is however not as torsionally rigid as the known mounting tube, so that undesired torsional loads might occur on the support element in the case of relatively large awning lengths and widths. In addition, it is fairly complicated to fasten bearing blocks or the like to the narrow central web without further weakening said bearing blocks or the like by holes or the like.

In contrast, in the novel design the torsional rigidity is to be increased and the possibility of fastening further components of the awning is to be simplified. DE-C-3708155 describes a reinforcing profile which is connected to a central support element, comparable with the design last described, and thus improves its torsional rigidity. At the same time, guide strips are formed on the reinforcing profile in this structure and are intended for holding profile parts which can be pushed therein and on which bearing blocks and the like can then be fastened. Although this known design thus has good stability, it also has a large number of additional components which complicate the mounting of the awning and furthermore require an increased production effort.

In contrast, the awning according to the invention should require fewer components but nevertheless have a simple mounting facility for bearing blocks or the like without impairing the torsional rigidity and flexural strength.

An awning structure described in DE-A-4308965 has a hollow chamber structure for holding bearing blocks and canvas shaft. However, as a result of its design, it has a relatively small horizontal flexural strength, so that its lateral length is limited. This known structure furthermore has a disadvantage in mounting: when the canvas shaft is installed, it must be held by the mounting personnel until it has been mounted in its lateral bearing points. If this is not done, it may slide out of the awning box. During mounting, several fitters or additional securing measures are therefore required.

A more recent awning design—published in WO92/14009—which is comparable with the awning first described and forming part of the prior art and which offers a practical fastening facility for bearing blocks or the like and occupies a smaller depth than the original mounting tube design has been developed by the Applicant. However, the advantage of the universal applicability of this mounting tube is accompanied by the disadvantage that it must have a certain strength which depends on the highest requirements in each case, so that with lower requirements, for example for an awning having a relatively narrow awning canvas, an excessively dimensioned mounting tube and therefore, in such a case, an unnecessary size of the total awning are present.

In contrast, less universality but instead a better degree of integratability and a smaller size are required for the design according to the invention.

SUMMARY OF THE INVENTION

The invention is thus based on all above-mentioned objects. A very small, narrow and flat awning having a high stability and strength is to be provided.

This object is achieved by the formation of a special one-piece support part which is now in the form of a sleeve rail having hollow profiles, which on the one hand provides an intrinsically stable, self-supporting component which holds the canvas shaft and the awning canvas and has high flexural strength and torsional rigidity and on the other hand suitable possibilities for connecting additional components, such as bearing blocks and the like. A separate mounting tube is completely dispensed with, advantageously resulting in a reduction of components in manufacture and stock-keeping. The novel awning thus belongs to the category of the awnings without mounting tubes, as were previously known in principle when the effects of the use of a mounting tube were not yet known.

Furthermore, the awning according to the invention dispenses with a narrow central web, which therefore also does not project perpendicularly upward in order to serve at the top as a point of engagement for a tilt limiter. Although it would be possible to provide a tilt limiter, the latter, in contrast to the known one, would have to engage a bearing block which can be fastened on the broader part of the sleeve structure; since, according to the invention, said bearing block may be positioned in a laterally displaceable manner, such a variant has the advantage that no preliminary work is required for fastening.

Although additional reinforcement profiles can also easily be mounted in the structure according to the invention, they are, according to the invention, no longer required, and, as already mentioned, the bearing blocks are fastened not on inserted reinforcing profiles but directly in the sleeve or its broader part.

An awning according to the invention is thus optimally small and stable; in addition, it manages with few components and moreover has advantages for the mounting of any desired additional parts, such as bearing blocks, which according to the invention are also laterally displaceable or can be mounted in the horizontal direction at any desired points of the rail. According to the invention, the support part or the sleeve rail is a central self-supporting component.

Self-supporting awning structures have already been disclosed, reference being made, for example, to a design "Kastenmarkise H 100" of "Helwe" (registered trademark of the company Helmut Weisbender AG & Co. KG). This known design has an elongated reverse F-shaped profile for lateral acceptance of the arm bearing and is therefore limited in the lateral extension. The profile cannot hold any additional arm bearings. Another disadvantage is that the arm bearings are not laterally displaceable. To this extent the object of requiring a very small space is not satisfactorily achieved by this design since, with greater lengths, several profiles must be provided side by side and the distance in between is lost. Troublesome for the user is in particular the fact that a gap remains between adjacent awning canvases and breaks the awning effect. In addition, the simple profile is also limited in its flexural strength in its vertical and horizontal directions owing to the lack of hollow profiles, so that the size of the awning canvas is limited.

The known design is thus a cheap design meeting only low strength requirements.

Combinations between the features described or individual aspects of the invention which can be applied independently of one another are also worth mentioning in connection with the invention.

With regard to the awning wall holder not described in particular detail in this Application, reference may be made to WO92/14009, which describes one of several possible practical wall holders, which wall holder is considered to have been described to the extent that it lies within the scope of this Application (cf. in particular Abstract and Figure with associated description of Figure).

BRIEF DESCRIPTION OF THE DRAWINGS

Preferred embodiments are described with reference to exemplary Figures which are not restricting with regard to the various aspects of the invention.

DETAILED DESCRIPTION OF PREFERRED EMBODIMENTS

List of Reference Symbols and Explanations

Figure 1:
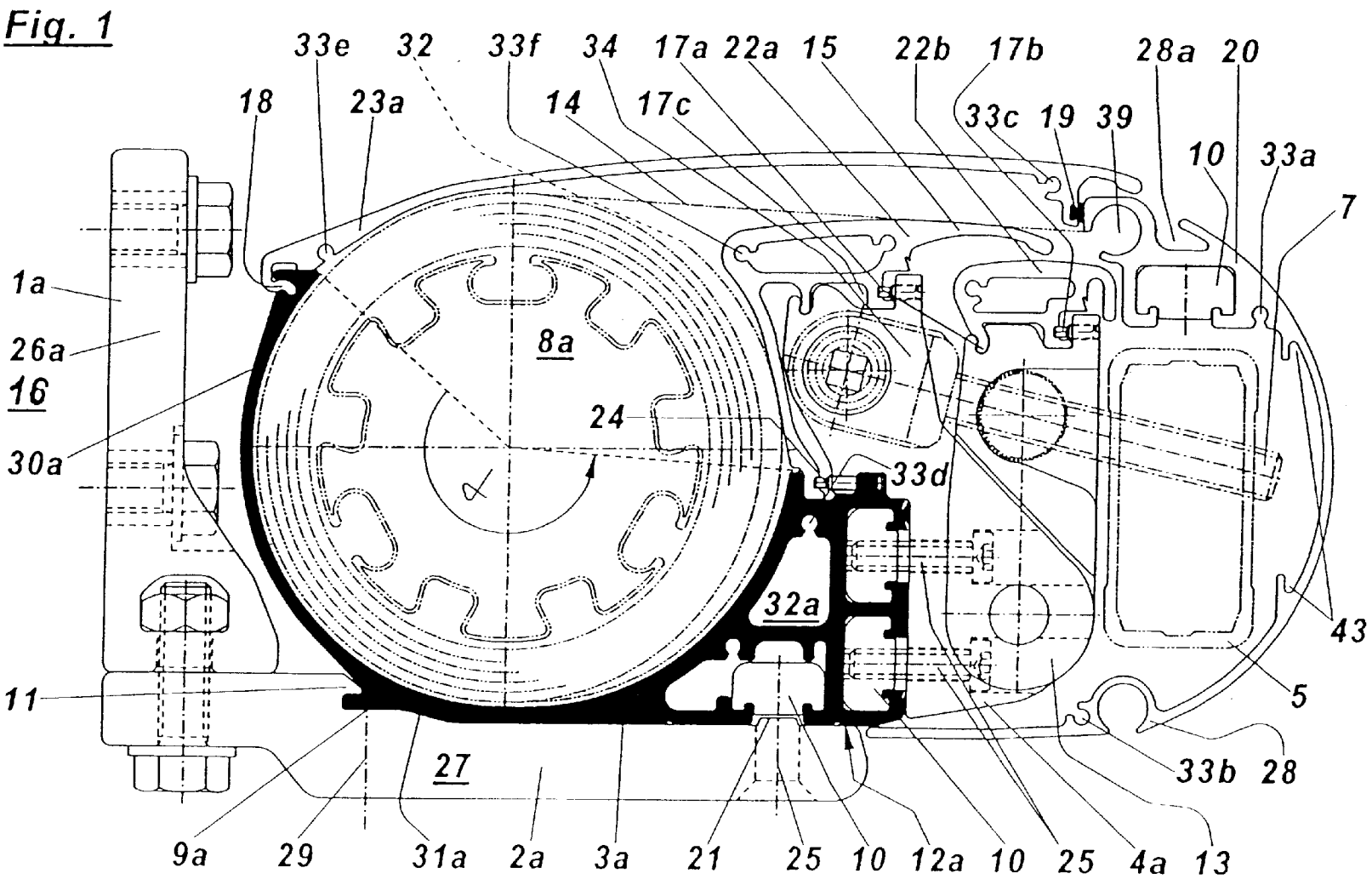
FIG. 1 shows a horizontal awning in section.

1 Wall holder serves as an interface between awning and wall, as in the conventional manner; the invention relates to wall holder 1*a* for conventional horizontal mounting, for a novel particularly depth-saving horizontal mounting according to the invention, now with downward-directed wall holder 1*c*, and for conventional vertical mounting 1*b*, as well as novel connections between the wall holder and the awning; the use of an inventive wall holder 1*c* is possible in principle only in those awnings which have good intrinsic stability since the wall holder itself and the wall behind it do not make any contribution known per se to the strength in the plane of the awning (cf. for example the design according to DE-A-4308965); it is precisely a combination of this aspect of the invention with the support part 3 according to the invention which is therefore advantageous;

of course, the other aspects of the invention are not limited to the wall holder 1 shown; thus, the novel awning can also usefully be held by means of ceiling holders known per se or the like.

2 Support arm serves for fastening the awning to the wall holders 1 in a manner known per se, the support arm 2*a* now having, for horizontal fastening, an inventive catch or securing projection element 11 which interacts with a diametrically opposite piece 9 of the support part or the sleeve rail 3; advantageously, upward-projecting parts of the support arm 2 are dispensed with, resulting in less danger of scratching of the lower part of the support part or of the sleeve rail 3 during mounting; as a special feature and an additional, independent aspect of the invention, the support arm 2*a–c* has a novel securing lug 21 in the region of fastening to the sleeve rail 3; this has, in the fastening region, a hole or a slot for the passage of a fixing bolt 25 which cooperates with a sliding nut 10; according to the invention, the hole or the slot is provided with a larger diameter than the bolt 25 so that an approximately cylindrical elevated part of the arm 2 having a concentric hole or a web running over the width of the arm and having a smaller width than the slot snaps therein resulting in temporary securing of the support part 3 during mounting, even before said support part is connected to the arm 2 by means of the bolts; for this securing aspect, which can also advantageously be used in other awning designs, however, the invention also relates to reverse variants in which parts projecting downwards from the support part or from the awning snap into corresponding recesses in the arm 2 and permanent fastening is then effected by means of bolts or the like.

3 Support part which, according to the invention, is in the form of a sleeve rail, that is to say performs a support function, a securing and holding function with partial enclosure and a rail function for insertion of fixing elements, connection of bearing blocks and the like; the sleeve rail according to the invention, which is preferably used together with the other aspects of the invention, can also be used independently of these; depending on the awning design (horizontal/vertical), it has slightly different attachments, which however together perform the above-mentioned functions;

the support part 3*a* (FIG. 1) differs from the support part 3*b* (FIG. 2) only in that the first performs the sleeve function more in the upper region with a high-fitting sleeve element 30*a* and the second performs the sleeve function more in the lower region with a projecting sleeve element 30*b*; apart from the sleeve function, according to the invention the sleeve element 30*a* also improves the flexural strength in the vertical direction while the sleeve element 30*b* improves the flexural strength in the horizontal direction; to this extent, both sleeve rail variants are particularly rigid in all directions;

the horizontal rigidity of the support part 3*a* is improved by a sleeve element 31*a* and a hollow profile 32*a* in the front region; conversely, the vertical rigidity of the support part 3*b* is improved by a sleeve element 32*b* which resembles the hollow profile and extends over a large part of the height of the awning;

a special novel holder which can also be used for other awnings and is adjustable with respect to inclination and/or balancing is provided by the upper region of the support part 3*b* or of the sleeve element 32*b*: two insertion parts 47*a* and 47*b* are each inserted into a groove in the wall holder 1*b* as well as in the sleeve rail 3*b*, in the grooves 50*a* and 50*b*, respectively, and are connected by means of adjusting screws 48; optionally provided lugs 49 in the grooves 50 provide securing means to prevent slipping out in an upward direction;

during mounting, the insertion parts 47*a,b* are inserted laterally into the grooves 50*a,b* and then connected by means of adjusting screw 48; depending on the position to which the screw 48 is turned, the upper regions of wall holder 1*b* and sleeve rail 3*b* are closer together or further apart; according to the invention, this gives rise to the possibility of individual adjustment of the sleeve rail 3*b* or another awning to which comparable insertion parts can be fastened, i.e. for providing it with a desired inclination relative to the wall behind the wall holder 1*b*, in order to adjust the tilting elasticity which depends on the fastening of the awning in the lower region to the support arm 2*b*; advantageously, unevenness of a wall in an upward direction can thus be compensated by setting the adjusting screws to different positions along the length of the awning.

4 Bearing block is a component which is known per se and which can be fastened in the grooved rails according to the invention by means of bolts 25 and sliding nuts 10 and can be moved laterally for mounting purposes; it bears at least one tilting block 13 and the load of swivel arms 5; furthermore, said bearing block holds a deflecting gear 32 known per se and therefore only indicated and having offset and eye and supports a bevel gear 34 for inclination adjustment; this optionally includes an automatic resetting device and, together with the bevel deflecting gears, permits inclinations from the horizontal to vertical in the extended state.

5 Swivel arm as known per se

6 Drop bar is, as known per se, clad with a cover 20 which, according to the invention, is composed of a metal profile, in particular of aluminium, and has a rain drainage channel 28 both in the upper region and in the lower region; according to the invention, side parts are fastened by means of bolts which can be screwed into continuous fixing channels 33; a receiving bore 39 known per se serves for holding the awning canvas 14, which is clamped there by means of strips or the like; according to the invention, the cover 20 is fixed to the drop bar by means of a bolt/sliding nut 10 connection which is indicated.

7 Tilt limiter as known per se can also be replaced by another tilt limiter.

Figure 2:
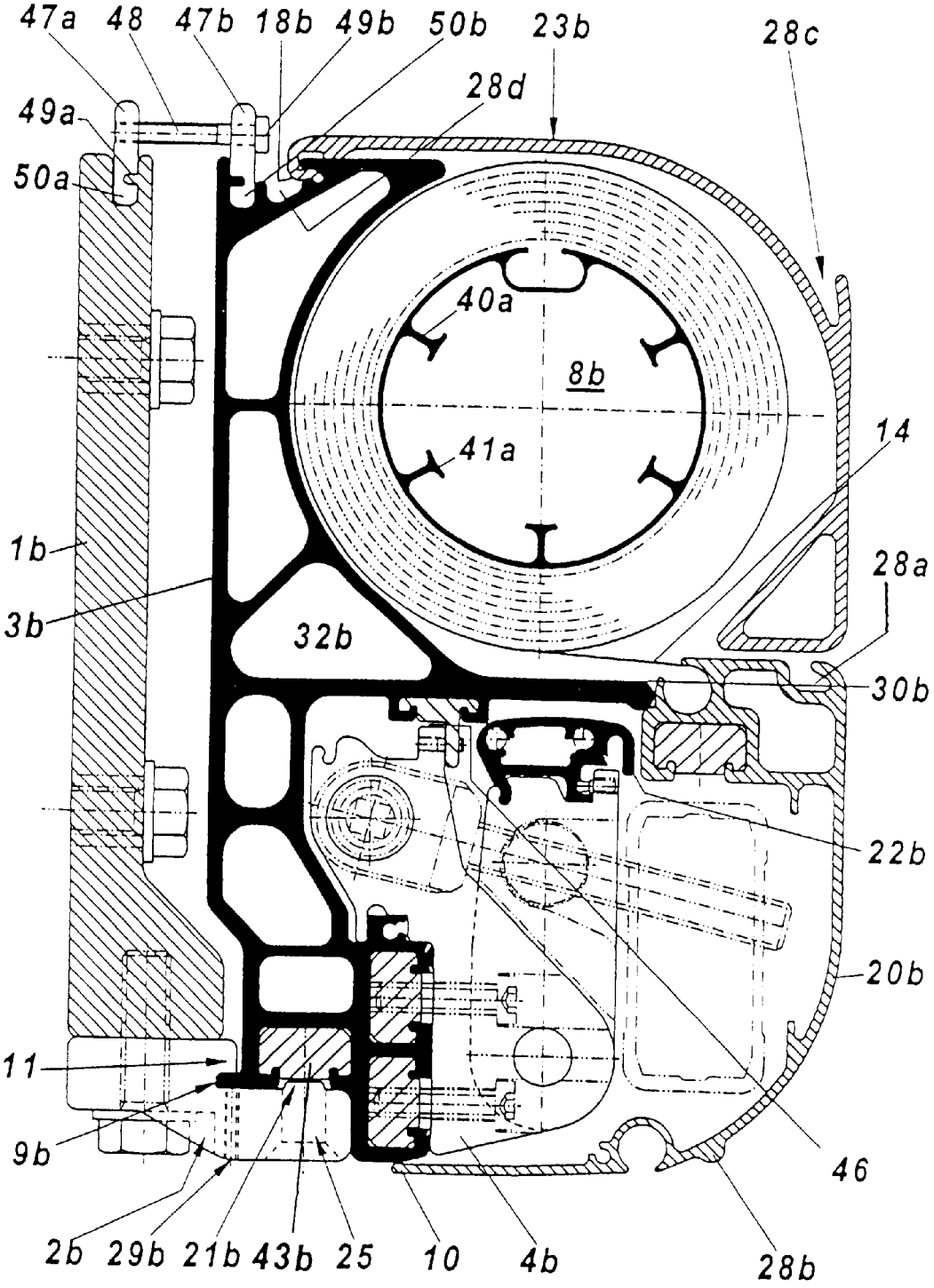
FIG. 2 shows a vertical awning in section.
Figure 3:
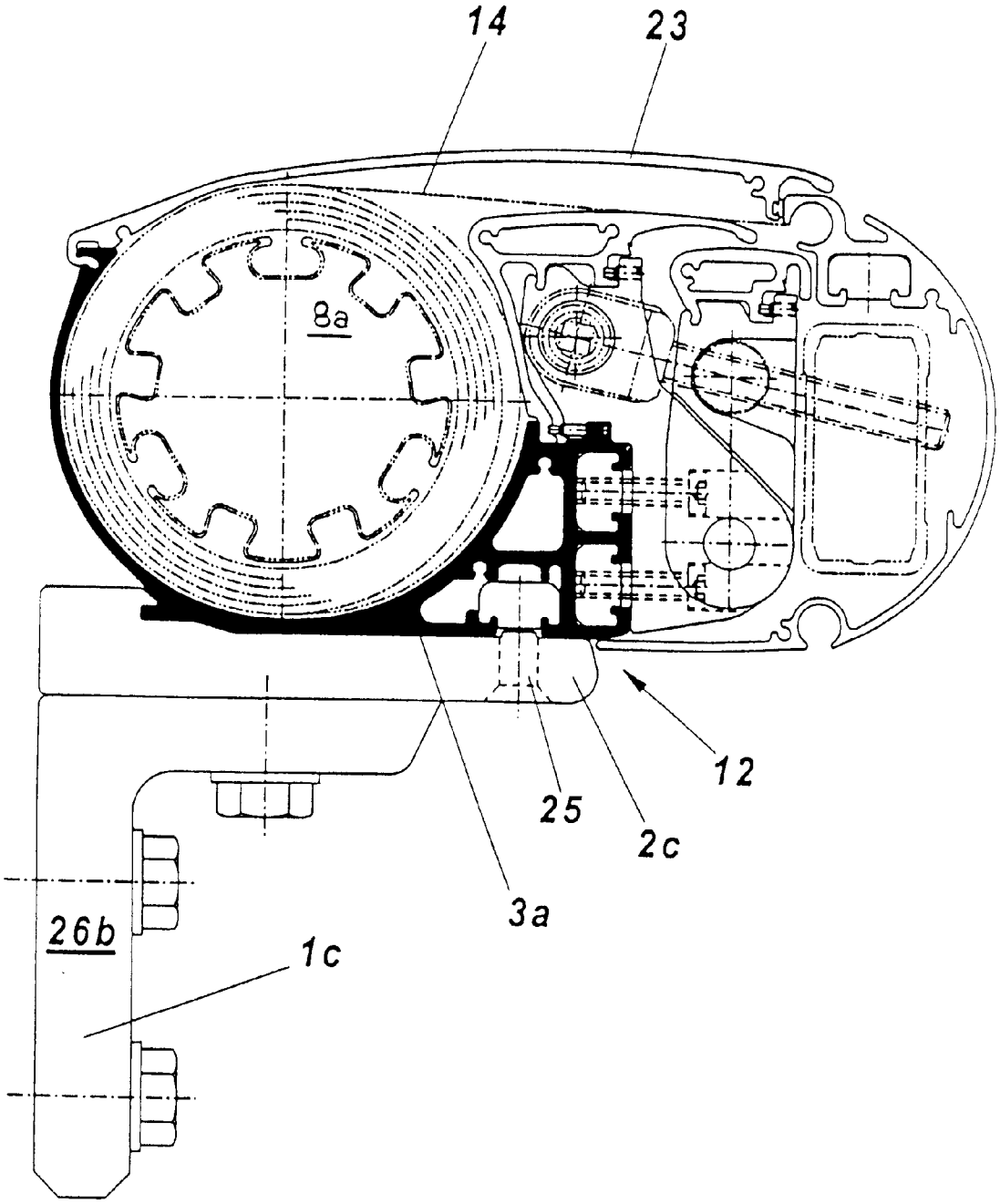
FIG. 3 shows a particularly short horizontal awning.
Figure 6:
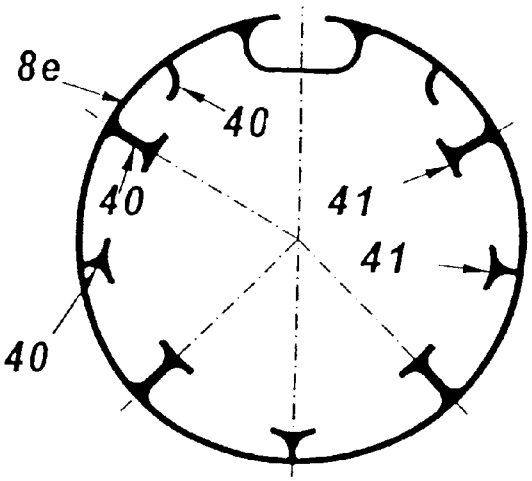
FIGS. 4 to 6 show variations of novel canvas shafts.
Figure 5:
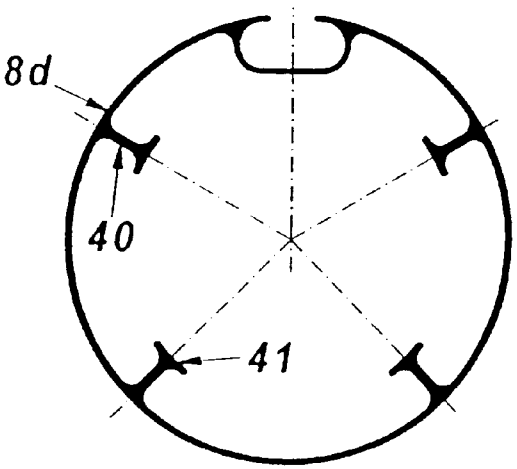
Figure 4:
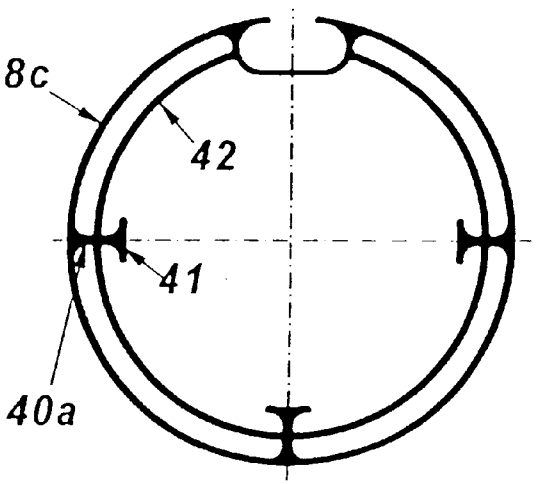

8 Canvas shaft as known per se is laterally mounted and carries the canvas; a novel shaft profile of the canvas shaft 8*b*, which profile is preferably to be used according to the invention, is shown in FIG. 2 and 3; variants thereof are shown in FIGS. 4 to 6; the novel profile can of course also be used for other awnings; their decisive advantage is that they have smaller external dimensions with approximately the same weight; the common inventive aspect of the canvas shafts according to FIG. 2 to 6 is inward-projecting profile lugs 40 which preferably project radially inwards and are optionally further stiffened by additional transverse profile sections 41 or by concentric pipe sections 42; as a particular embodiment, the shaft can be perforated over its circumference in order to permit good admission of air to the awning canvas in the rolled-up state; in a particular embodiment, the sleeve rail too could for the same reason have perforations, for example in the region of the element 30*a*; this inventive concept is not limited to the present awning structure.

9 Connection is a lug-like projection which, as mentioned, cooperates with the securing projection 11 of the support arm 2*a,c* and serves for fixing the sleeve rail to the support arm 2*a,c*; in a particular embodiment, this is additionally fixed by means of a bolt 29 which is indicated.

10 Sliding nuts can be pushed into the slots in the broader part 12 of the profile and serve as a counter part for fixing bolts 25; for a detailed description thereof, reference may be made to International Patent Application WO93/14283 of the Applicant, in which the principle and the variants of the sliding nuts 10 are described; regarding the variants, the description of the WO application mentioned is considered to be disclosed herein; preferably the same sliding nuts 10 are used on the entire awning also for fixing the cover 20 to the swivel arms 5.

11 Securing projection

12 Broader part with slots and hollow profiles serves for mounting of components, such as holders, blocks, etc. in a laterally displaceable manner and for stiffening the sleeve rail to prevent horizontal and vertical bending; a particular advantage of this structure is the introduction of the large forces on the awning directly into the most stable—broader part—thereof which, according to the invention and preferably, is also connected directly to the wall holder 2 which thus additionally contributes to the stability.

13 Tilting block as known per se for adjusting the inclination of the swivel arms; at its upper end, it has grooves 17*a* for holding a deflecting pipe 22*b* on which the awning canvas slides in the extended state.

14 Awning canvas

15 Deflecting lip of the deflecting pipe 22*a*, which is fastened to the bearing block 4*a* and to the broader part 12.

16 Wall of a house or the like.

17*a–c* Grooves in or on which something can be fastened;

18 Snap groove serves for snapping in a cover part 23.

19 Seal permits rain-tight closing of the awning housing in the retracted state and enables the awning to be closed quietly, particularly if the seal is in the form of a hollow chamber profile and is made of cellular rubber or the like;

20 Cover

21 Securing lug

22 Deflecting pipe serves for protecting the awning canvas in the extended state and prevents the canvas 14 from touching the swivel arm or other components of the awning which ensure a smooth, straight dropping of the canvas in the extended state; according to the invention, the deflecting lip 15 of the rear deflecting pipe 22*a* is lengthened towards the front in such a way that, in the retracted state, it extends over the other deflecting pipe 22*b* and thus prevents jamming of the awning canvas between the two novel deflecting pipes which may also be used independently; this measure furthermore ensures that the tilting block 13 swivels back safely. According to the invention, the novel deflecting pipes also improve the stability of the awning both in the horizontal and in the vertical direction.

23 Cover part or roof of the awning protects the latter in a manner known per se.

24 Screw fastening of the deflecting pipe

25 Fixing bolt

26 Perpendicular bar of the wall holder

27 Horizontal bar of the wall holder

28 Drip or rain channel; channel 28*b* prevents water from flowing back to the support arm 2 while the channel 28*a* allows rain water to run off laterally before it can flow from the cover part (roof) 23 onto the cover 20; according to a special embodiment of the invention or of other awnings, a perpendicular drainage channel which cooperates with the rain channel 28*a* to remove rain water directly downwards may be provideded in the lateral cover parts of the awning which are not shown and which may also be provided with a cover 20. Alternatively, it would also be possible to connect a hose section which removes any rain water downwards;

according to the invention, further rain drainage channels are possible, especially in the case of vertical designs; 28*c* and d help in removing water in the region of the roof 23*b* (FIG. 2).

29 Bolt

30 Sleeve element; in the horizontal variant according to FIG. 1, this sleeve element 30*a* is narrow and relatively far above canvas shaft 8*a*; not however so far that the canvas shaft can no longer be inserted from above during mounting, which is an important advantage over awnings in which the canvas shaft can only be inserted laterally; in the vertical variant, this element 30*b* is in the form of a broad hollow profile into the top of which the roof 23*b* is hooked after the canvas shaft has been inserted and mounted.

31 - - - " - - -

32 Deflecting gear with offset and eye or electric drive makes it possible to drive the bevel gear 34, which is disclosed in WO 93/14331 B and is preferably inserted from below in the invention since it is itself also particularly small;

33 Fixing channels for lateral cover mounting or the like.

34 Bevel gear

39 Holder for awning canvas and strip

40 Profile lugs for strengthening the canvas shaft;

41 Transverse web for strengthening the canvas shaft;

42 Concentric pipe sections for strengthening the canvas shaft;

43 Insertion grooves in the cover 20*a* into which a stiffening means can be inserted;

44 Slot;

45 Bolt;

46 Push-in holder serves for additional fastening of the bearing block 4*b* at its upper end and itself inserted into a corresponding recess in the part 30*b* of the sleeve rail 3*b*; this provides additional strengthening effects.

47 Insertion part for mutual fastening or fixing of the awning in the upper region to the wall holder 1*b*;

48 Adjusting screw for compensation and adjustment of the inclination of the awning with respect to local wall regions;

49 Lugs serve for additional retention of the insertion parts 47 in grooves 50 to prevent removal in the vertical direction;

50 Groove for insertion parts 47.

Supplementary Description of the Figures

The Figures are described in relation to one another, identical components bear the same reference symbols, different components with comparable functions have identical reference symbols with different indices.

FIG. 1 shows an awning according to the invention in the horizontal design with a wall holder 1*a* and a support arm 2*a*. A sleeve rail 3*a* according to the invention, together with a covering 23*a* and a cover 20*a*, forms the housing of the novel particularly compact awning. A broad part 12*a* serves for holding a bearing block 4*a* and a deflecting pipe 22*a* which supports an awning canvas 14. The deflecting pipe 22*a* is broadened with a deflecting lip 15 in such a way that, in the retracted state, a further deflecting pipe 22*b* which is fastened to a tilting block 13 is partially covered. Extension of the awning and tilting of the tilting block thus result in smooth and trouble-free guidance of the awning canvas 14. A novel connection 9 which permits preliminary fixing and subsequently good vertical fixation during mounting, even before holes 25 with sliding nuts 10 fix the awning in a manner known per se, is provided in the lower rear region. In the connection 9, a diametrically opposite securing projection 11 of the support arm 2*a* is positioned opposite. A bolt 29 which is turned through the support arm 2*a* optionally secures this connection by pressing against the securing projection 11.

The other components of the awning have already been described in the list of reference symbols and essentially correspond to those components which are known as conventional ones to a person skilled in the art.

Figure 7:
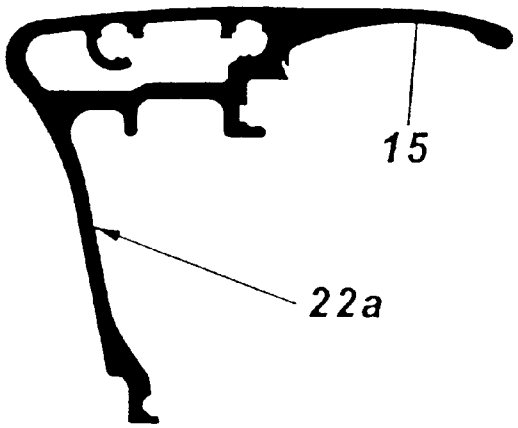
FIG. 7 shows a novel deflecting profile for the awning canvas.
Figure 9:
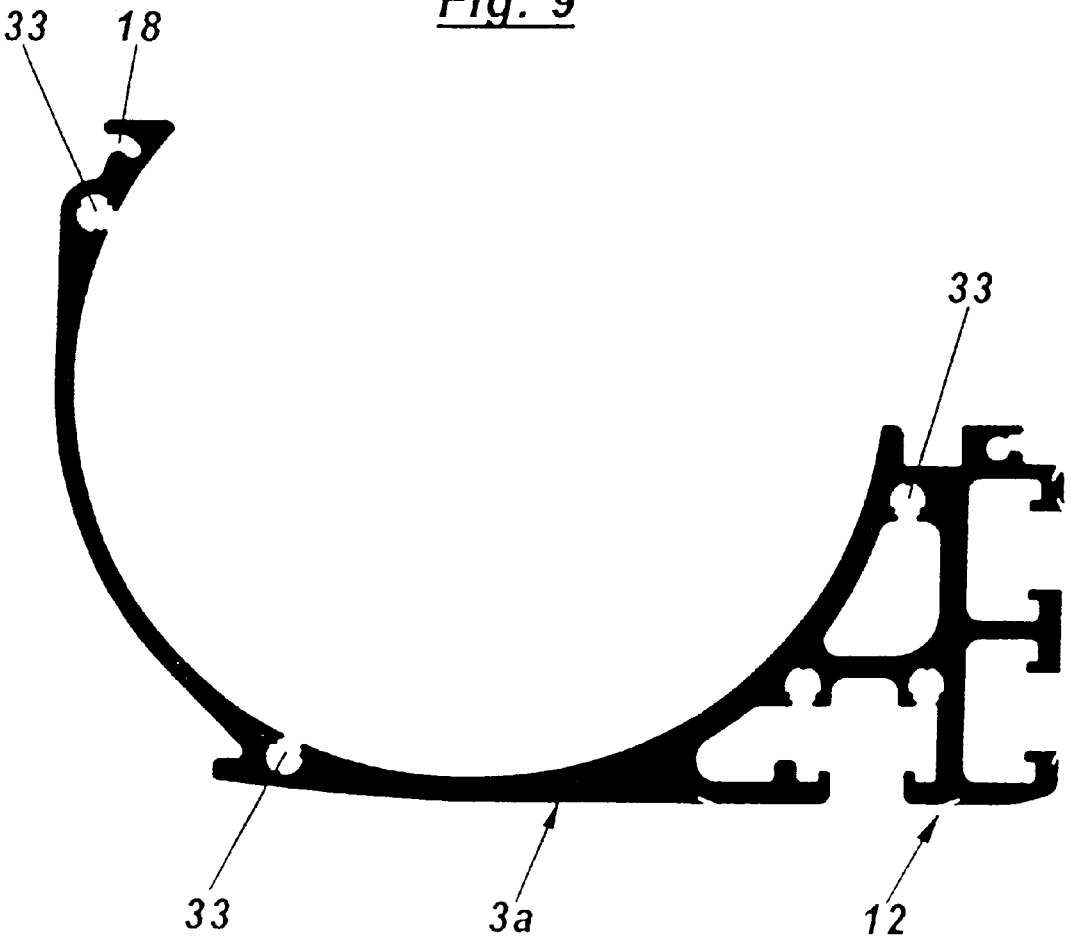
FIG. 9 shows a novel sleeve rail profile.

In combination, the result is a particularly compact readily integrated awning. The inventive novel profiles of a sleeve rail 3*a* and of a deflecting pipe 22*a* are shown in FIGS. 9 and 7.

An alternative to the canvas shaft profile 8*a* shown in FIG. 1 is a canvas shaft profile 8*b* according to FIG. 2 or canvas shaft profiles 8*c–e* according to FIGS. 4–6. With identical strength, the novel canvas shaft profiles have smaller external diameters, facilitating the integratability and compact design of the awning according to the invention. Of course, these novel canvas shaft profiles can also be used in other awnings.

The variant according to FIG. 2 shows a vertically mounted awning with, accordingly, slightly modified support part (or sleeve rail) 3*b*, which is distinguished by hollow profiles and a sleeve element 30*b* which serves for supporting the canvas shaft 8*b* during mounting and for good flexural strength in the horizontal direction.

The support arm 2*b* is appropriately shortened and, as in FIG. 1, provided with a novel securing means 21*b* which may also be used in other awnings and snaps into the slots 43*b* in the support part 3*b* before the two parts are connected by means of the bolt 25.

The variant according to FIG. 3 is distinguished by an extremely short design in the horizontal direction by virtue of the fact that the vertical arm of the wall holder 1*c* is turned downward and the support arm 2*c* is accordingly shortened. The resulting advantage according to the invention is that the additional fastening of the lug-like projection 9 by means of a bolt 29 can be dispensed with since a bolt 25, turned through the support arm 2*c*, makes contact with the sleeve rail 3*a* and thus clamps both the support arm 2*a* and the sleeve rail 3*a* on the support arm 2*c* so that there is no rocking. Mounting by means of a ceiling holder is also possible, nuts or threaded or sliding blocks preferably being used there and cooperating with horizontal fixing bolts.

Figure 8:
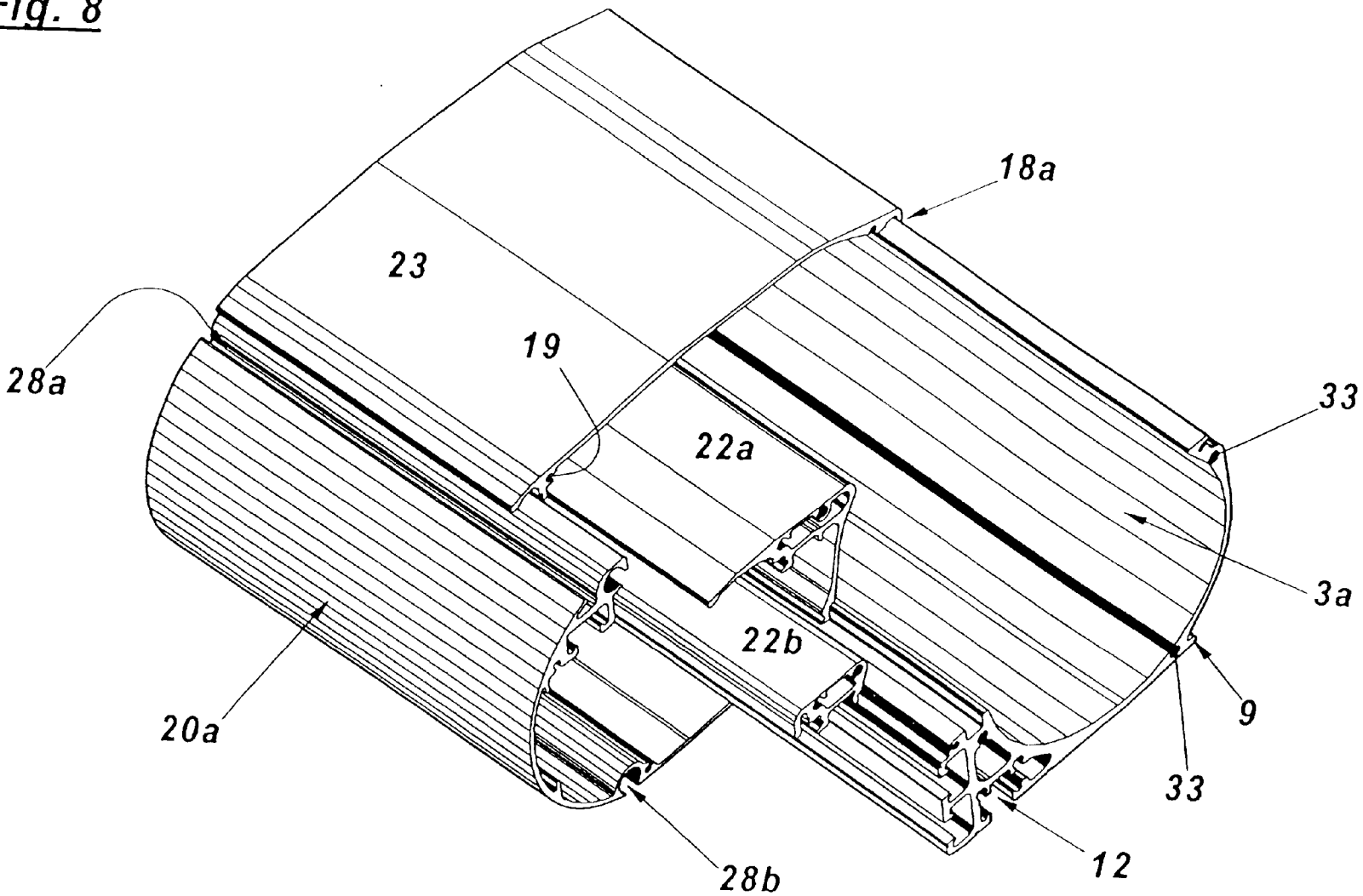
FIG. 8 shows a variant according to FIG. 1 in oblique view.

FIG. 8 shows the structure according to FIG. 1 or 3 in an inclined view.

This description of the Figures, together with the list of reference symbols and the disclosure in the patent claims in which further concepts according to the invention are described, forms a unit with regard to the presentation of all aspects of the invention, and the pieces of information thus mutually supplement each other.

I claim:

1. An awning comprising a canvas shaft (8), at least one holder (1) for fastening to a wall (16) or ceiling, at least one support arm (2) fastened to the holder (1), at least one support part (3) fastened to the support arm (2), at least one bearing block (4) fastened to the support part (3), supporting at least one swivel arm (5) for a drop bar (6) or a tilt limiter (7), in which the support part (3) comprises a one piece sleeve rail (3) that encloses the canvas shaft (8) over an angle of at least 90 to 100°, and the sleeve rail (3) has a front region with a broader part (12) with peripheral grooves (10) that serve as connections for components of the awning.

2. The awning according to claim 1, in which the sleeve rail (3) has at least one connection (9*a*) with a lug-shaped projection for the support arm (2), which connection (9) cooperates with a diametrically opposite securing projection (11) on the support arm (2), the connection (9*a*) on the sleeve rail being fixed from below through the support arm (2) by a fastener (29).

3. The awning according to claim 1, in which the sleeve rail (3) extends in a region of the broader part (12) up to approximately a horizontal plane in which an axis of the canvas shaft is located.

4. The awning according to claim 1, in which the angle over which the one piece sleeve rail (3) encloses the canvas shaft (8) is at least 150°.

5. The awning according to claim 4, in which the angle is at least 180°.

6. The awning according to claim 4, in which the sleeve rail (3) forms an open casing for reception of the canvas shaft (8).

7. The awning according to claim 6, in which the casing is open at the top or obliquely in an upper part of a front of the sleeve rail (3).

8. The awning according to claim 1, in which the support arm (2) and the sleeve rail (3) have opposed parts, and the sleeve rail (3) has on a side facing away from the holder (1) a fastening connection in which the opposed parts of the support arm (2) and the sleeve rail (3) snap together, further comprising a securing lug (21) on the support arm (2) that engages in an opening (44) in the sleeve rail (3).

9. The awning according to claim 1, further comprising at least one bearing block (4), at least one tilting block (13) connected to the at least one bearing block (4), at least one swivel arm (5) fastened to the at least one tilting block (13), a first deflecting pipe (22) fastened to support an awning canvas at an upper end of the at least one bearing block (4), a second deflecting pipe (22) fastened to support an awning canvas at an upper end of the at least one tilting block (13).

10. The awning according to claim 9, in which one of the deflecting pipes (22) extends over the other deflecting pipe (22).

11. The awning according to claim 9, in which one of the deflecting pipes is closer to the canvas shaft (8) and has a broadened deflecting lip (15) that extends over the other deflecting pipe (22) when the awning is in a retracting state.

12. The awning according to claim 1, in which the bearing block (4) has grooves (17*a–c*) into which deflecting pipes (22) are snapped, one deflecting pipe being connected to the broader part (12).

13. The awning according to claim 1, further comprising a cover part (23) that covers the canvas shaft (8), the sleeve rail (3) having in an upper region, a locking groove (18) into which the cover part (23) snaps.

14. The awning according to claim 13, in which the cover part (23) cooperates with a cover (20) for protecting an awning canvas (14) when the awning is in a retracted state, and a seal (19) of elastic material having a tubular profile is situated between the cover part (23) and the cover (20).

15. The awning according to claim 12, further comprising a cover (20) on the swivel arm (5) or the drop bar (6), which cover (20) has in an upper region a drip channel (28) for lateral removal of water and for keeping a front of the cover (20) free from floating substances and in a lower region a drip lug (28*b*) for preventing rain water from flowing back.

16. The awning according to claim 1, in which the support arm (2) is L-shaped in side view, the support arm (2) having a perpendicular bar (26) that is oriented downward and a horizontal bar (27) is shortened so that the canvas shaft (8) is closer to the wall (16) than when the perpendicular bar (26) is mounted in an upward direction.

17. A canvas shaft for an awning according to claim 1, comprising a tubular profile with approximately radially inward projecting profile lugs (40) with transverse webs (41).

18. A canvas shaft according to claim 17, further comprising concentric pipe sections (42) forming an integral piece.

19. The canvas awning according to claim 17, in which the tubular profile is perforated.

20. The awning according to claim 1, in which insertion parts (47*a–b*) are inserted into grooves (50*a–b*) in the wall holder (1*b*), and the insertion parts (47*a–b*) are inserted in grooves (50*a–b*) in the support part (3*b*), which insertion parts are connected one to the other.

21. The awning according to claim 20, in which the insertion parts are connected one to the other by an adjusting screw (48), and lugs (49) are provided in the grooves (50*a–b*) for securing the insertion parts (47*a–b*).

* * * * *